United States Patent [19]

Mall et al.

[11] 4,418,629

[45] Dec. 6, 1983

[54] DEVICE FOR MAKING DARTS ON CUT PARTS OF GARMENTS

[75] Inventors: Günther Mall; Willi Stephan, both of Kaiserslautern, Fed. Rep. of Germany

[73] Assignee: Pfaff Industriemaschinen GmbH, Fed. Rep. of Germany

[21] Appl. No.: 234,756

[22] Filed: Feb. 17, 1981

[30] Foreign Application Priority Data

Oct. 10, 1980 [DE] Fed. Rep. of Germany ... 8027080[U]

[51] Int. Cl.[3] ..... D05B 35/08

[52] U.S. Cl. ..... 112/146

[58] Field of Search ..... 112/146, 144, 136, 137; 233/35, 38

[56] References Cited

U.S. PATENT DOCUMENTS 417,692 12/1889 Weiss ..... 112/146

4,022,138 5/1977 Strickland ..... 112/146

*Primary Examiner*—Peter P. Nerbun

*Attorney, Agent, or Firm*—McGlew and Tuttle

[57] ABSTRACT

A device for making darts on cut parts for use with a sewing machine which has a reciprocating needle mounted over a support table for engagement with the material to be sewn and wherein the material to be sewn is moved along the table by a feeding mechanism, comprises, a pleating bar support plate which is mounted for movement around the needle and carries a pleating bar which is movable therewith for adjustable positioning in respect to the table. The support plate for the pleating bar may be adjustably positioned and the limit of its adjustment is governed by a stop which is adjustably positionable relative to the support plate. The stop advantageously comprises a rotatable multi-step stop which is carried on a lever arm so that it may be shifted relative to the support plate. The lever arm is advantageously biased in a direction so that the stop engages the support plate. The lever is connected with a drive device for effecting its adjustment. The associated mechanism may include one or more stop elements, each of which comprises rotatable stop deives with strike faces which may be adjustably positioned and selectively positioned relative to the support plate for the pleating bar.

7 Claims, 4 Drawing Figures

DEVICE FOR MAKING DARTS ON CUT PARTS OF GARMENTS

FIELD AND BACKGROUND OF THE INVENTION

This invention relates to sewing devices in general and, in particular, to a new and useful device for making darts on cut parts of garments for use with a sewing machine which includes an adjustable pleating bar which may have its movement limited by at least one multi-step stop.

In the known devices for making darts, for example, in the sewing system known from German Pat. No. 16 60 839, a table top carrying a pleating bar is disposed before the sewing table top in the plane of the table top bearing surface. The table top is fastened on two sliding rods which are mounted slidable toward the sewing machine in guides disposed under the sewing table top and pivotable about the longitudinal axis of the needle, so that the table top can be adjusted with the pleating bar determining the form of the dart at an angle to the feed presser bar leading the work past the stitch-forming point on the sewing table top. The pivot range of the table top is limited by stops and the angular position can be read on a scale. The dart depth, which depends on the garment size, is determined by the angular position of the pleating bar around which the garment to be made is folded, and by the position of the garment parts on the pleating bar. Marks may be provided for positioning or the pleating bar may have a corresponding form. The above-mentioned scale is the only means for changing the angular position of the table top with respect to the pleating bar.

It has been found that it is extremely difficult to bring the table top with the pleating bar repeatedly into exactly defined angular positions by this means. The setting must be especially precise for the sewing of pleats in pleated skirts, because a deviation from the nominal pleat depth of as little as 0.1 mm per pleat will add up to a considerable deviation from the garment size, which is unacceptable in the industry. In making pleated skirts, it is furthermore a requirement to vary the number or depth of the pleats in the back of the skirt as compared with the number or depth in the front of the skirt. Accordingly, the position of the pleating bar must be changed as soon as the pleats of one skirt part are sewn.

SUMMARY OF THE INVENTION

The present invention provides a device having a pleating bar which can be adjusted to different dart depths, while always maintaining the same precision.

By the use of multi-step stops, it is possible to define a plurality of positions of the pleating bar adapted to the various garment sizes or dart depths and to bring the pleating bar precisely into each of the selected positions as often as required. Accordingly, it is an object of the present invention to provide a device for making darts on cut parts for use with a sewing machine which has a reciprocating needle mounted over a support table for engagement with the material to be sewn and which is moved along the table by a feeding mechanism and, wherein, the device includes a pleating bar support plate mounted for movement around the needle, carrying a pleating bar and wherein the movement limits are established by at least one stop which is mounted in the path of movement of the plate and which is adjustable relative to the plate.

The stop for eliminating the movement of the support plate and hence the pleating bar advantageously comprises a multi-step stop which is disposed on a lever which is pivoted relative to the pleating bar about a fixed axle and wherein the pivot range of the lever is limited by at least one additional multi-step stop. The lever is connected with a drive device for operating it and each multi-step stop is fixable in the operational position of each step by a ratchet device.

A further object of the invention is to provide a device for making darts on cut parts of garments for use with a sewing machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figures 1, 3:
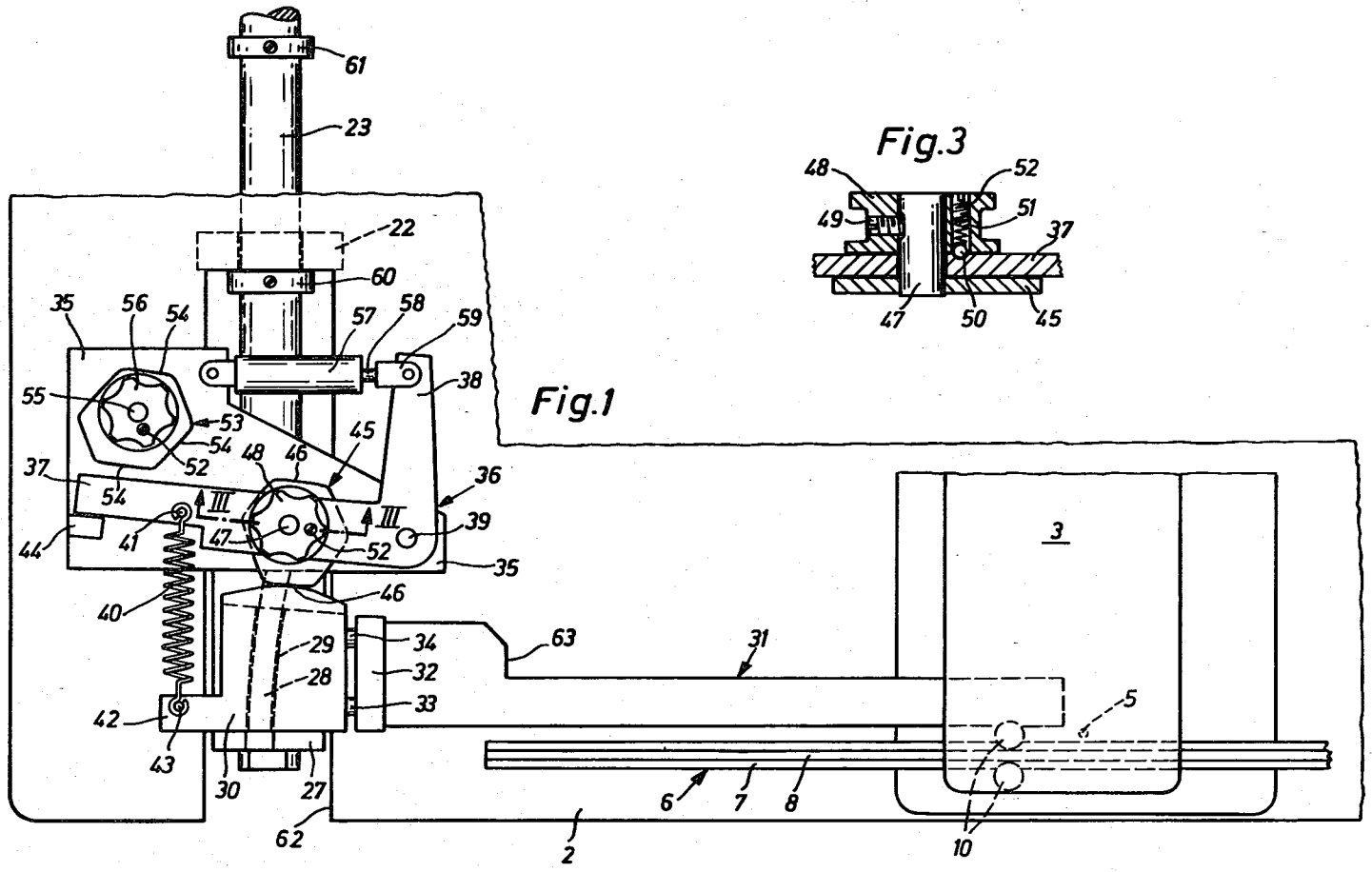
FIG. 1 is a partial top plan view of a sewing machine having a pleating device constructed in accordance with the present invention.
FIG. 3 is a section taken along the line III—III of FIG. 1.

Referring to the drawings in particular, the invention embodied therein, comprises, a sewing device for making darts on cut parts of garments with a pleating bar, generally designated 31, which is adjustable within a zone which is limited by stops, generally designated 45 and 53.

In a sewing table top 2, carried by a support or standard 1, a sewing machine 3 is installed with the longitudinal axis of its arm shaft approximately perpendicular to the front edge of the sewing table top 2.

A thread-carrying needle 5 is fastened on a needle bar 4 of the sewing machine which is moving up and down, and cooperates for stitch formation with a looper (not shown). The sewing machine 3 is driven by a clutch motor (not shown) which is disposed below the sewing table top 2 and can be stopped in a predetermined position of its sewing tools, e.g., in a needle-up position.

A work feed device comprises a feed bar 6 of inverted T-shape cross-section having a sole 7 which is covered with a grippy material, such as foam plastic or plush. A web 8 of the feed bar 6 is guided between two pins 10 which are fastened on the presser bar 9 of the sewing machine 3. A piston rod 11 of a compressed air cylinder 12 presses the feed bar 6 down onto the work to be transported. The compressed air cylinder 12 is disposed on a driver 13, which is secured on a chain 16 passed over sprocket wheels 14 and 15 located under the sewing table top 2 and driving the feed bar 6, with the chain, in turn, being driven by a drive motor 17, secured on the standard 1. For straight guiding, a pin 18 is fastened in the feed bar 6. Pin 18 slides in a guideway 19 provided at the upper end of the driver 13. The device is controlled by a central unit 20, containing means for the sequence control of the individual motions, and control of the operation of the sewing machine is advantageously effected under the control of micro-switches or photocells (not shown).

The driver 13, connected with chain 16, is guided for displacement on two lengthwise guiding rods 21 extending parallel to each other and to the front edge of the sewing table top 2 and disposed below the latter on the standard 1. A slide rod 23, guided for displacement in bearing webs 22 (only one is shown in FIG. 1), is mounted under sewing table top 2, perpendicular to the lengthwise guiding rods 21, and is secured against rotation. The slide rods 23 have a groove 24 into which the rib 25 of a guide block 27, fastened by screws 26 to the slide rod 23, is inserted. On its top side, the guide block 27 has an arch-type dovetail guide 28 which engages in a dovetail groove 29 on the underside of a support plate 30 for a pleating bar 31. The arch of guide 28 is part of a circle whose center is the longitudinal axis of the needle bar 4.

One end of the pleating bar 31 has a vertical web 32, in which two plug-in pins 33 and 34 are fastened, which are to be plugged into corresponding bores in the support plate 30. To secure the plugged position, a locking device (not shown) may be provided.

A metal plate 35 is fastened on guide block 27. An angle lever 36, with arms 37 and 38 is fastened to metal plate 35 and is mounted pivotable about a bearing pin 39. By its arm 37, the angle lever 36 is under spring tension toward a fixed stop 44 of plate 35 and toward the support plate 30 by an extension spring 40 which engages by one end at a pin 41 fastened in arm 37 and by the other end at a pin 43 fastened in a projection 42 of support plate 30.

On an imaginary prolongation of the median line of the arch-type dovetail guide 28, a disc-type stop 45 with several strike surfaces 46 dimensionally graded to its axis of rotation and provided with marks is mounted on arm 37 of angle lever 36 for rotation about a bearing pin 47. The bearing pin 47 is firmly connected with stop 45, for example, by soldering. A setting knob 48 is fastened on the upper end of bearing pin 47 by means of a screw 49. In a bore of the knob 48, there is arranged as a ratchet device for stop 45, a ball 50, which is under the action of a compression spring 51, whose spring force is variable by a screw 52.

Depressions for ball 50 are provided in arm 37 of angle lever 36, by which the operating positions of the strike surfaces 46 are established, securing stop 45 in the respective position against unintended displacement. The support plate 30 with the pleating bar 31 is pulled by the extension spring 40 to make contact on the strike surface 46 of stop 45. By each of the strike surfaces 46, a different angular position fitted for a certain garment size of the cut parts to be sewn, and hence, a sewing depth of the pleating bar 31 adapted to the garment size, is defined.

To fulfill the requirement for rapid change of the dart depth when sewing pleated skirts, an additional disc-type stop 53 with several strike surfaces 54 dimensionally graded to its axis of rotation and provided with marks is mounted on the metal plate 35 for rotation about a bearing pin 55. Bearing pin 55 is firmly connected with stop 53, e.g., by soldering. An adjustment knob 56 is fastened on the upper end of bearing pin 55. A ratchet device consisting of a ball 50, compression spring 51 and screw 52, is likewise disposed in a bore of knob 56.

Similar to stop 45, stop 53 can also be fixed by the ratchet device 50 to 52 in several angular positions corresponding to the operating positions of the strike surfaces 54 and determined by depressions in the metal plate 35 for the ball 50.

To pivot the angle lever 36 out of the position shown in FIG. 1 into a position in which arm 37 abuts on one of the strike surfaces 54, there serves a compressed air cylinder 57, the casing of which is articulated at one end to the metal plate 35 and whose piston rod 58 carries a forked head 59 which is articulatedly connected with the free end of arm 38 of angle lever 36.

To limit the displacement path of the slide rod 23 carrying the strike device and the support plate 30 with the pleating bar 31, and hence, to define the sewing position and the work-insertion position of the pleating bar 31, two set rings 60 and 61 are fastened on the slide rod 23. In the sewing position, shown in FIG. 1, set ring 60 applies against one side of a bearing web 22, while in the work-insertion position, set ring 61 applies against the other side of bearing web 22.

The guide block 27, fastened on slide rod 23, moves in a cutout 62 of the sewing table top 2 upon displacement of the slide rod 23. Alternatively, the set ring 60 could be replaced by a stop 45 or 53, in order to define the sewing position of the pleating bar 31 and, hence, the pleat depth by displacement of the pleating bar 31 perpendicularly to the front edge of the sewing table top. It should further be mentioned that for darts of different form and size, correspondingly formed pleating bars can be made available and inserted into the support plate 30 when needed. As an insertion aid, a contact edge may be provided on each pleating bar (e.g., 63 in pleating bar 31) for the work edge.

Figures 2, 4:
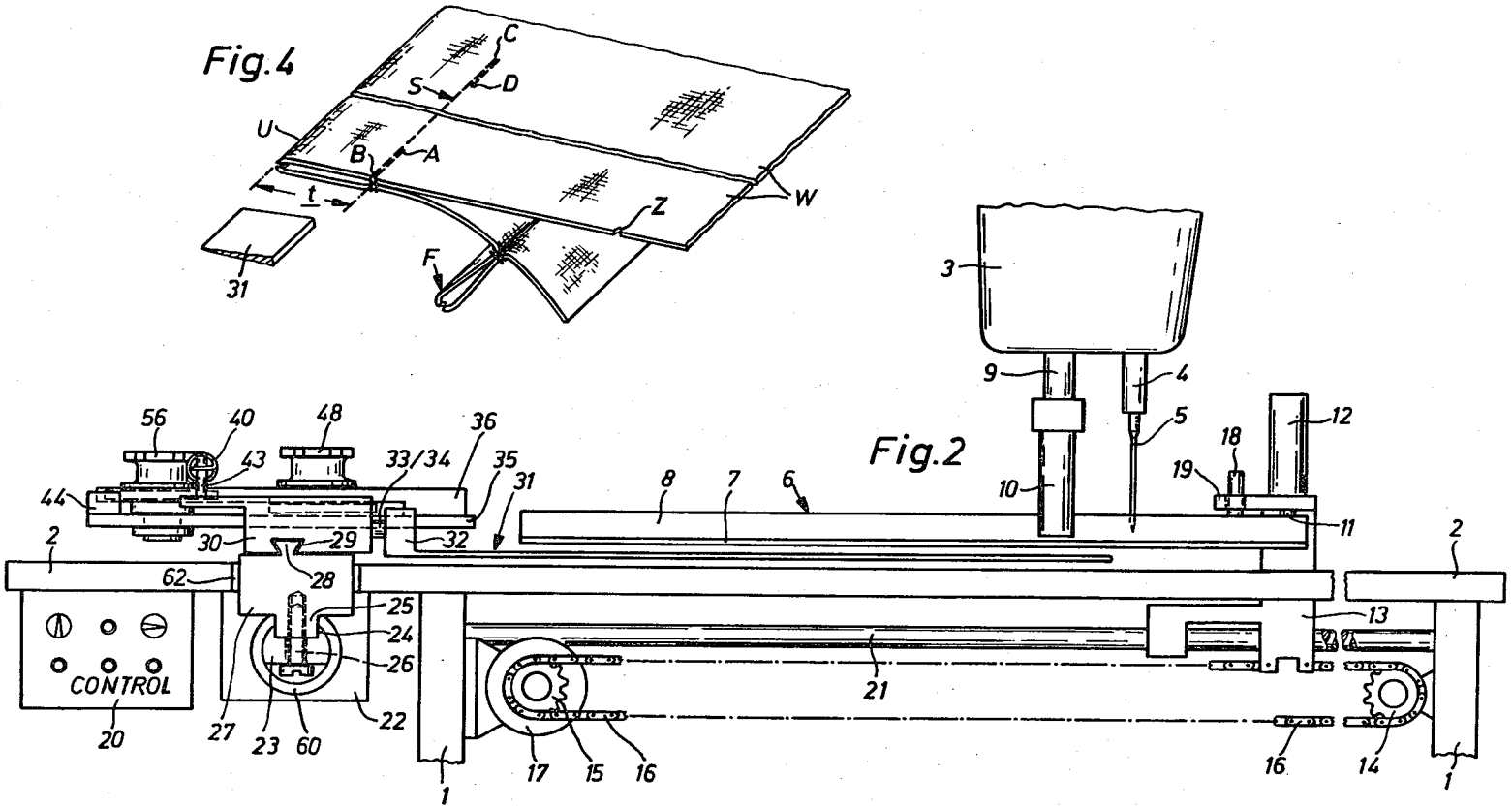
FIG. 2 is a partial elevational view of the apparatus shown in FIG. 1.
FIG. 4 is a perspective view, partly broken away, of a sewing pattern of a pleated skirt made with the device of the invention.

Operation of the device:

It is assumed that the feed bar 6 is lifted off the sewing table top with the sewing machine 3 stopped in the needle-up position; that the stops 45 and 53 occupy an angular position which corresponds to the correct sewing depth t for a certain garment size, FIG. 4, for the skirt pleats F; that under the action of the extension spring 40, the support plate 30 applies against the strike surface 46 of stop 45, arm 37 of angle lever 36 applies against the fixed stop 44, and slide rod 23 with the parts disposed thereon is displaced from the sewing position illustrated in FIG. 1 into the work-insertion position, in which set ring 61 applies against the bearing web 22 and the pleating bar 31 is in spaced relation before the front edge of the sewing table top 2. This premised, the operation of the device when sewing pleats F of a pleated skirt, of which a sewing pattern is shown in FIG. 4, is as follows:

The cut part W, marked at the lateral edge by notches Z or other marks for the position of the fold edges U of the skirt pleats F, is folded by the seamstress around the pleating bar 31 in the amount to be sewn off, with the cut part W being placed with a notch Z marking a fold edge U against the front edge of the pleating bar 31. The slide rod 23 with the strike device and with the pleating bar 31 with the cut part W is then displaced by hand or by a mechanical drive device into the sewing position, FIG. 1, of the pleating bar 31 under the feed bar 6 with the set ring 60 abutting on the bearing web 22. The feed bar 6 is then lowered by the working piston of the compressed air cylinder 12 onto the cut part W and pushes it against the sewing table top 2 next to the pleating bar 31. By actuation of a switch, a sequential control program now begins to take place, where first the motor 17 is switched on and by the feed bar 6 is connected via driver 13 with the chain 16 driven by motor 17. The cut part W is displaced with point A under the needle 5 in rapid motion from left to right and, in so doing, is pulled off the pleating bar 31, which thereafter, is again moved into the work-insertion position of the pleating bar 31. Thereupon, the sewing machine 3 is switched on and, at the same time, the speed of motor 17 is reduced.

The cut part W is moved by the feed bar 6 with point B under needle 5 with formation of the seam-start lock A-B. In this position, the direction of rotation of motor 17 is reversed and, thereafter, pleat F is sewn by seam S on the dart depth t determined by the pleating bar 31 and by the position of stop 45. When point C is under the needle, the direction of rotation of motor 17 is again reversed to sew the end lock C-D. As soon as the last stitch is formed at D, motor 17 is switched off and the sewing machine 3 is stopped in the needle-up position after the threads have been cut off. The feed bar 6, which is again in its starting position, is now lifted; the cut part W is received and folded in the amount to be sewn off to form the next pleat F around the pleating bar 31 at the point marked by an additional notch Z, whereupon, the described program begins anew.

In this way, a predetermined number of pleats F is sewn. For sewing the pleats in the back panel of the skirt, which have a greater depth t than the pleats in the front panel, a solenoid valve (not shown) which controls the air supply to the compressed air cylinder 57 is turned on by actuation of a switch. By the piston rod 58 connected with the working piston, and by the forked head 59, the angle lever 36 is pivoted about the bearing pin 39 in such a way that arm 37 abuts on the strike surface 54 of stop 53. Under the action of the extension spring 40, the support plate 30 with the pleating bar 31 follows the movement of the angle lever 36 into another position, which corresponds to a greater depth t of the pleats F.

With their dimensionally graded strike surfaces 46 and 54, the stops 45 and 53 offer additional possibilities for varying the sewing depth to adapt the position of the pleating bar 31 to the different garment sizes of the cut parts to be sewn. For this purpose, the stops can be rotated about their bearing pins 47, 55 into the respective angular position and be secured there by the ratchet device 50–52.

While a specific embodiment of the invention has been shown and described in detail to illustrate the application of the principles of the invention, it will be understood that the invention may be embodied otherwise without departing from such principles.

What is claimed is:

1. A device for making darts on cut parts of a garment and for use with a sewing machine having a reciprocating needle mounted over a support table for engagement with the material to be sewn which is moved along the table by a feeding mechanism, comprising, a pleating bar support plate, means mounting said support plate for movement around a longitudinal axis of the needle, a pleating bar carried by said support plate projecting toward the needle from said support table and being movable with said support plate for adjustable positioning in respect to the table, and at least one stop mounted adjacent said pleating bar support plate and being adjustably positionable relative to said support table in the path of movement of said support plate to vary the end position of movement of said support plate which occurs when said support plate contacts said stop to determine the depth of the pleats depending on the size of a garment to be pleated.

2. A device, as claimed in claim 1, wherein said stop comprises a rotational disc having multi-step stop faces cooperating with said support plate, a lever member pivotally mounted adjacent said pleating bar and having first and second arm portions, said first arm portion carrying said stop.

3. A device, as claimed in claim 2, including a second stop mounted alongside said lever arm and being adjustably positionable relative to said lever arm to vary the end position of movement of said lever arm.

4. A device for making darts on cut parts for use with a sewing machine having a reciprocating needle mounted over a support table for engagement with the material to be sewn which is moved along the table by a feeding mechanism, comprising, a pleating bar support plate, means mounting said support plate for movement around the needle, a pleating bar carried by said support plate and being movable therewith for adjustable positioning in respect to the table, at least one stop mounted adjacent said pleating bar support plate and being adjustably positionable relative to said support table in the path of movement of said support plate to vary the end position of movement of said support plate which occurs when said support plate contacts said stop, said stop comprising a multi-step stop, a lever member pivotally mounted adjacent said pleating bar and having first and second arm portions, said first arm portion carrying said stop, and a second stop mounted alongside said lever arm and being adjustably positionable relative to said lever arm to limit the movement of said lever arm.

5. A device, as claimed in claim 4, including a stop carrying plate disposed adjacent said lever arm, said carrying plate having a fixed stop disposed along one side of said first lever arm, said second stop comprising an adjustable stop element mounted on said stop support plate and being adjustable relative to said first lever arm to limit the opposite end position thereof.

6. A device, as claimed in claim 5, including a fluid pressure operated member connected between said stop support plate and said second lever arm for pivoting said second lever arm.

7. A device, as claimed in claim 4, wherein there are at least two separate stops for controlling the end position of said pleating bar, each stop comprising a multi-step stop which may be fixed in an operative position and including ratchet means for holding said stop in an operative position.

* * * * *